US007806666B2

(12) United States Patent
Umemura et al.

(10) Patent No.: US 7,806,666 B2
(45) Date of Patent: Oct. 5, 2010

(54) DISPLACEMENT CONTROL VALVE OF VARIABLE DISPLACEMENT COMPRESSOR

(75) Inventors: Satoshi Umemura, Kariya (JP); Yuji Hashimoto, Kariya (JP); Tatsuya Hirose, Kariya (JP); Kazutaka Oda, Kariya (JP); Masataka Taniue, Kariya (JP); Ryosuke Cho, Tokyo (JP); Keigo Shirafuji, Tokyo (JP); Toshiaki Iwa, Tokyo (JP)

(73) Assignee: Eagle Industry Co. Ltd., Tokyo (JP)

( * ) Notice: Subject to any disclaimer, the term of this patent is extended or adjusted under 35 U.S.C. 154(b) by 448 days.

(21) Appl. No.: 11/449,419

(22) Filed: Jun. 7, 2006

(65) Prior Publication Data

US 2006/0280616 A1 Dec. 14, 2006

(30) Foreign Application Priority Data

Jun. 8, 2005 (JP) ..... 2005-168707

(51) Int. Cl.
*F04B 1/26* (2006.01)

(52) U.S. Cl. ..... 417/222.2; 417/213; 417/216

(58) Field of Classification Search ..... 417/222.2, 417/213, 216

See application file for complete search history.

(56) References Cited

U.S. PATENT DOCUMENTS 5,702,235 A * 12/1997 Hirota et al. ..... 417/222.2
5,964,578 A * 10/1999 Suitou et al. ..... 417/222.2
6,354,811 B1 * 3/2002 Ota et al. ..... 417/222.2
6,772,990 B2 8/2004 Sasaki et al. ..... 251/129.03
7,037,087 B2 5/2006 Uemura et al.
2003/0145615 A1 * 8/2003 Sasaki et al. ..... 62/228.3

(Continued)

FOREIGN PATENT DOCUMENTS

EP 1 033 490 A2 9/2000

(Continued)

OTHER PUBLICATIONS

Office Action for corresponding JP Application No. 2005-168707, dated Jan. 5, 2010.

(Continued)

*Primary Examiner*—Devon C Kramer
*Assistant Examiner*—Christopher Bobish
(74) *Attorney, Agent, or Firm*—Locke Lord Bissell & Liddell LLP

(57) ABSTRACT

A displacement control valve (32) is connected to a variable displacement compressor. An open passage (53) in which a refrigerant gas flows is formed within a rod (31) and a valve body (30) of the displacement control valve (32). Further, an inner circumferential surface of a valve chamber (36) is formed as a guide portion (40) for moving the valve body (30) along an axis (L1) of the valve chamber (36). A valve portion (30*a*) of the valve body (30) is formed in a circular arc cross sectional shape along a surface of a sphere (K) in which an intermediate point of a length of the guide portion (40) along the axis (L1) of the valve chamber (36) is set to a center (N) on the axis (L1), and a distance from the center (N) to a contact point between a valve seat (36*a*) and the valve portion (30*a*) is set to a radius (r).

16 Claims, 4 Drawing Sheets

U.S. PATENT DOCUMENTS

2005/0265853 A1* 12/2005 Hirota ..... 417/222.2

FOREIGN PATENT DOCUMENTS

| | | | |
|---|---|---|---|
| JP | 53-166125 | | 12/1978 |
| JP | 64-27487 | U | 2/1989 |
| JP | 06-006855 | U | 1/1994 |
| JP | 10-332016 | A | 12/1998 |
| JP | 2000-249051 | A | 9/2000 |
| JP | 2002-364533 | A | 12/2002 |
| JP | 2003-322086 | | 11/2003 |
| JP | 2004-116407 | A | 4/2004 |

OTHER PUBLICATIONS

Office Action for corresponding JP Application No. 2005-168707, dated Sep. 15, 2009.

* cited by examiner

DISPLACEMENT CONTROL VALVE OF VARIABLE DISPLACEMENT COMPRESSOR

BACKGROUND OF THE INVENTION

The present invention relates to a displacement control valve which constitutes a refrigerant circulation path and is used in a variable displacement compressor capable of changing a refrigerant displacement on the basis of a pressure in a control pressure zone within the compressor.

This kind of variable displacement compressor forms a part of the circulation path in which a refrigerant gas corresponding to a fluid circulates, for example, in an air conditioner for a vehicle. The variable displacement compressor is provided with a control pressure chamber (a control pressure zone), and a swash plate is arranged in the control pressure chamber in such a manner that a inclination thereof can be changed. The inclination of the swash plate is changed in correspondence to a pressure in the control pressure chamber. In this variable displacement compressor, if the pressure in the control pressure chamber becomes higher, and an inclination angle of the swash plate becomes smaller, a stroke of pistons becomes smaller, and a displacement of the refrigerant gas is reduced. On the other hand, if the pressure in the control pressure chamber becomes lower, and the inclination angle of the swash plate becomes larger, the stroke of the pistons becomes larger, and the displacement of the refrigerant gas is increased.

To the variable displacement compressor, there are connected a gas passage for supplying the refrigerant gas to the control pressure chamber from the discharge pressure zone, and a displacement control valve for opening and closing the gas passage. The displacement control valve is provided with a solenoid portion, and a pressure sensing means for actuating a valve body in correspondence to the pressure of the refrigerant gas. The solenoid portion is provided with a tubular fixed iron core, and a movable iron core and a rod coupled to the movable iron core are inserted to the fixed iron core.

The displacement control valve is provided with a valve chamber within a housing, and a valve body is arranged in the valve chamber so as to be capable of reciprocating. The valve chamber is provided with a guide portion for moving the valve body along an axis of the valve chamber. The valve body is fixed to an end portion in an opposite side to the movable iron core in the rod. In this displacement control valve, if an electromagnetic force is generated in the solenoid portion, the valve body reciprocates together with the rod. The valve portion of the valve body selectively contacts and separate from a valve seat of the valve chamber on the basis of a reciprocation of the valve body. Accordingly, a valve hole and the gas passage are selectively opened and closed so as to adjust a supply amount of the refrigerant gas from the discharge pressure zone to the control pressure chamber.

For example, a displacement control valve disclosed in Japanese Laid-Open Patent Publication No. 2003-322086 is structured such that no excessive pressure is applied to the pressure sensing means at a time when the valve body is opened, by introducing a pressure in a suction pressure zone into the valve body. In this case, in order to introduce the pressure in the suction pressure zone into the valve body, an open passage is formed within the rod and the valve body in such a manner as to communicate with the suction pressure zone.

In this displacement control valve, in order to smoothly move the rod and the valve body, a clearance is formed between the rod and the fixed iron core, and between the valve body and the guide portion. There is a case that the clearance allows the valve body and the rod to tilt with respect to an axis of the valve chamber. If the valve hole is closed in this state, a problem happens that a gap is formed between the valve body and the valve seat and the refrigerant gas leaks from the gap. Particularly, in the case that the open passage is formed within the rod and the valve body, it is necessary to make diameters of the rod and the valve body large. Accordingly, the gap between the valve body and the valve seat becomes large, and a leaking amount of the refrigerant gas from the gap is increased.

SUMMARY OF THE INVENTION

Accordingly, it is an objective of the present invention to provide a displacement control valve of a variable displacement compressor which prevents a refrigerant gas from leaking from a portion between a valve portion and a valve seat, even if a circulation path is formed within a rod and a valve body.

To achieve the foregoing and other objectives, one aspect of the present invention provides a displacement control valve that forms a part of a circulation path of a refrigerant gas and is used in a variable displacement compressor capable of changing a displacement of the refrigerant gas. The displacement control valve includes a valve chamber, a valve body, a rod, actuation means, a flow passage, and a guide portion. The valve chamber is provided within the displacement control valve and forms a part of a gas passage in which the refrigerant gas flows. The valve chamber has an axis and a valve seat. The valve body is movably arranged within the valve chamber. The valve body has a valve portion. The valve portion selectively contacts and separates from the valve seat of the valve chamber, whereby the gas passage is selectively opened and closed. The rod is integrally moving with the valve body. The actuation means actuates the rod for positioning the valve body within the valve chamber. The flow passage is provided within the rod and the valve body. The refrigerant gas flows through the flow passage. The guide portion moves the valve body along an axis of the valve chamber. At least one of the valve portion and the valve seat is formed along a surface of an imaginary sphere in which an intermediate point of a length of the guide portion along the axis of the valve chamber is set to a center on the axis, and a distance from the intermediate point to the contact point between the valve seat and the valve portion is set to a radius.

Another aspect of the present invention provides a seal structure of a valve apparatus. The seal structure includes a valve chamber, a valve body, a rod, actuation means, a flow passage, and a guide portion. The valve chamber is provided within the valve apparatus and forms a flow path in which a fluid flows. The valve chamber has an axis and a valve seat. The valve body is movably arranged within the valve chamber. The valve body has a valve portion. The valve portion selectively contacts and separates from the valve seat of the valve chamber, whereby the flow path is selectively opened and closed. The rod integrally moves with the valve body. The actuation means actuates the rod for positioning the valve body within the valve chamber. The flow passage is provided within the rod and the valve body. The fluid flows through the flow passage. The guide portion moves the valve body along an axis of the valve chamber. At least one of the valve portion and the valve seat is formed along a surface of an imaginary sphere in which an intermediate point of a length of the guide portion along the axis of the valve chamber is set to a center on the axis, and a distance from the intermediate point to the contact point between the valve seat and the valve portion is set to a radius.

DETAILED DESCRIPTION OF THE PREFERRED EMBODIMENTS

First Embodiment

A description will be given below of a first embodiment according to the present invention with reference to FIGS. 1 to 4.

Figure 1:
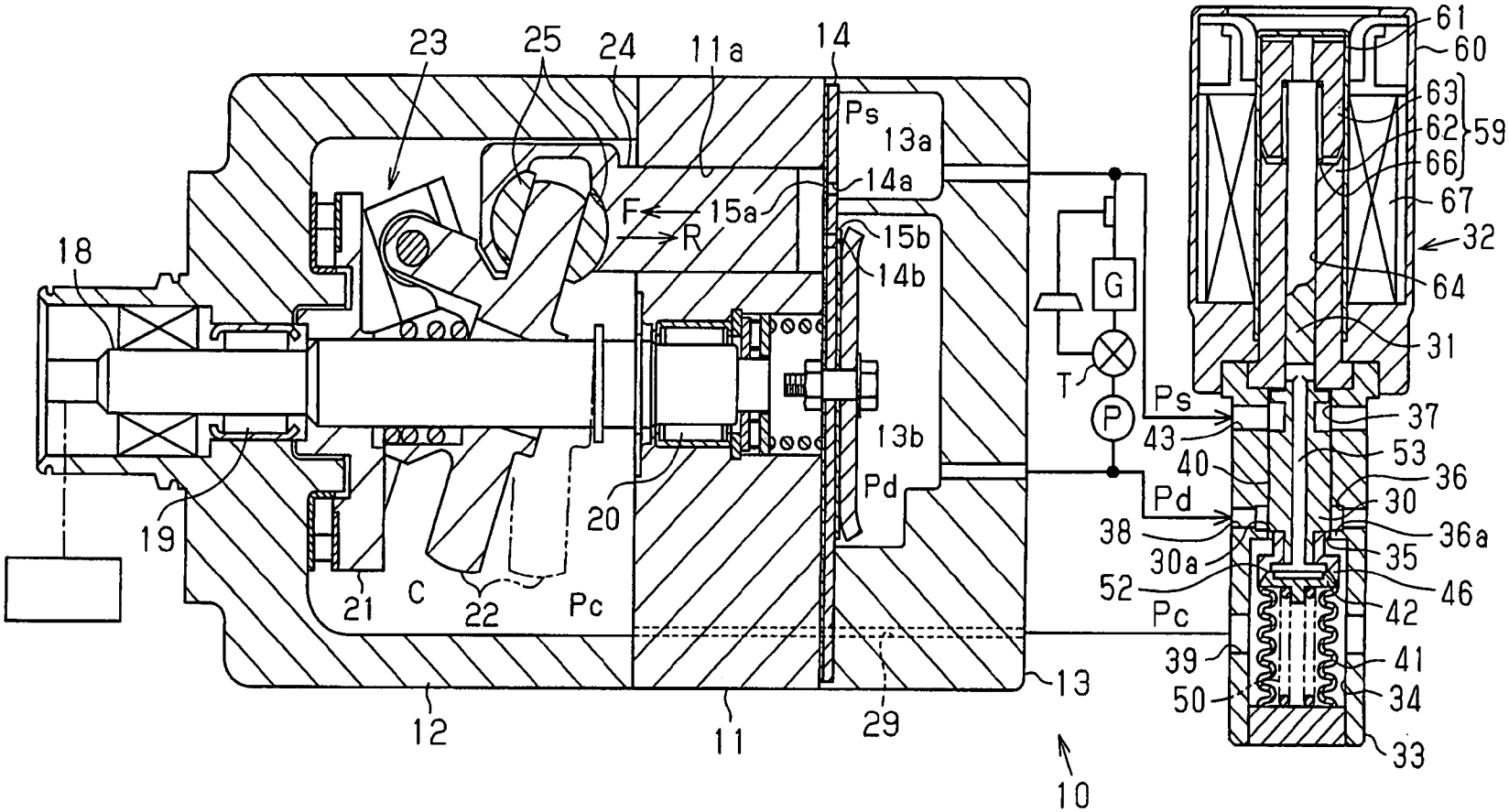
FIG. 1 is a longitudinal cross-sectional view showing a variable displacement compressor and a displacement control valve in accordance with first and second embodiments.

As shown in FIG. 1, a variable displacement compressor 10 is provided with a cylinder block 11, and a front housing member 12 is attached to a front end of the cylinder block 11. Further, a rear housing member 13 is attached to a rear end of the cylinder block 11 via a valve and port forming body 14.

A control pressure chamber C is defined between the front housing member 12 and the cylinder block 11. In the control chamber C, a front end portion of a shaft body 18 is rotatably supported to the front housing member 12 via a first radial bearing 19, and a rear end portion of the shaft body 18 is rotatably supported to the cylinder block 11 via a second radial bearing 20. A rotary support 21 is fixed to an approximately center of the shaft body 18, and a swash plate 22 is supported thereto in such a manner as to be slidable along an axis of the shaft body 18 and be tiltable with respect to the axis. The swash plate 22 is coupled to the rotary support 21 via a hinge mechanism 23. The hinge mechanism 23 supports the swash plate 22 in such a manner as to be tiltable with respect to the rotary support 21, and couples the rotary support 21 and the swash plate 22 in such a manner that a torque is transmitted to the swash plate 22 from the shaft body 18.

If a center portion of the swash plate 22 moves close to the rotary support 21, inclination of the swash plate 22 with respect to the axis of the shaft body 18 becomes large. The inclination of the swash plate 22 is regulated on the basis of a contact between the rotary support 21 and the swash plate 22. A solid line in FIG. 1 shows a state in which the inclination angle of the swash plate 22 is maximum, and two-dot chain line shows a state in which the inclination angle of the swash plate 22 is minimum.

A plurality of cylinder bores 11*a* are formed in the cylinder block 11. A piston 24 is accommodated within each of the cylinder bores 11*a* (only one cylinder bore 11*a* is illustrated in FIG. 1). If the shaft body 18 is rotated and the swash plate 22 is rotated, a rotating motion is converted into a reciprocating motion of the pistons 24 within the cylinder bores 11*a* via shoes 25. A suction chamber 13*a* and a discharge chamber 13*b* are defined within the rear housing member 13. In this case, a suction pressure of the refrigerant gas in the suction chamber 13*a* is referred to as Ps, and a discharge pressure of the refrigerant gas in the discharge chamber 13*b* is referred to as Pd. Suction ports 14*a* and suction valve flaps 15*a* are formed in the valve and port forming body 14 in correspondence to the suction chamber 13*a*, and discharge ports 14*b* and discharge valve flaps 15*b* are formed therein in correspondence to the discharge chamber 13*b*. Further, a pressure of the refrigerant gas in the control pressure chamber C is referred to as a control pressure Pc. In the present embodiment, the suction chamber 13*a* corresponds to the suction pressure zone, the discharge chamber 13*b* corresponds to the discharge pressure zone, and the control pressure chamber C corresponds to the control pressure zone.

If each piston 24 is moved to a front side (in a direction F shown in FIG. 1), the refrigerant gas within the suction chamber 13*a* opens the suction valve flap 15*a* and flows into the cylinder bore 11*a* from the suction port 14*a*. If the piston 24 is moved to a rear side (in a direction R shown in FIG. 1), the refrigerant gas flowing into the cylinder bore 11*a* opens the discharge valve flap 15*b* and is discharged to the discharge chamber 13*b* from the discharge port 14*b*. On the basis of the reciprocating motion of the pistons 24 mentioned above, the refrigerant gas is discharged to the discharge chamber 13*b* from the cylinder bores 11*a*, is thereafter supplied to an evaporation chamber G via a condensation chamber P and an expansion valve T, and is again returned to the suction chamber 13*a*. In the present embodiment, the refrigerant circulation path is constituted by the variable displacement compressor 10, the condensation chamber P, the expansion valve T and the evaporation chamber G.

Figure 2:
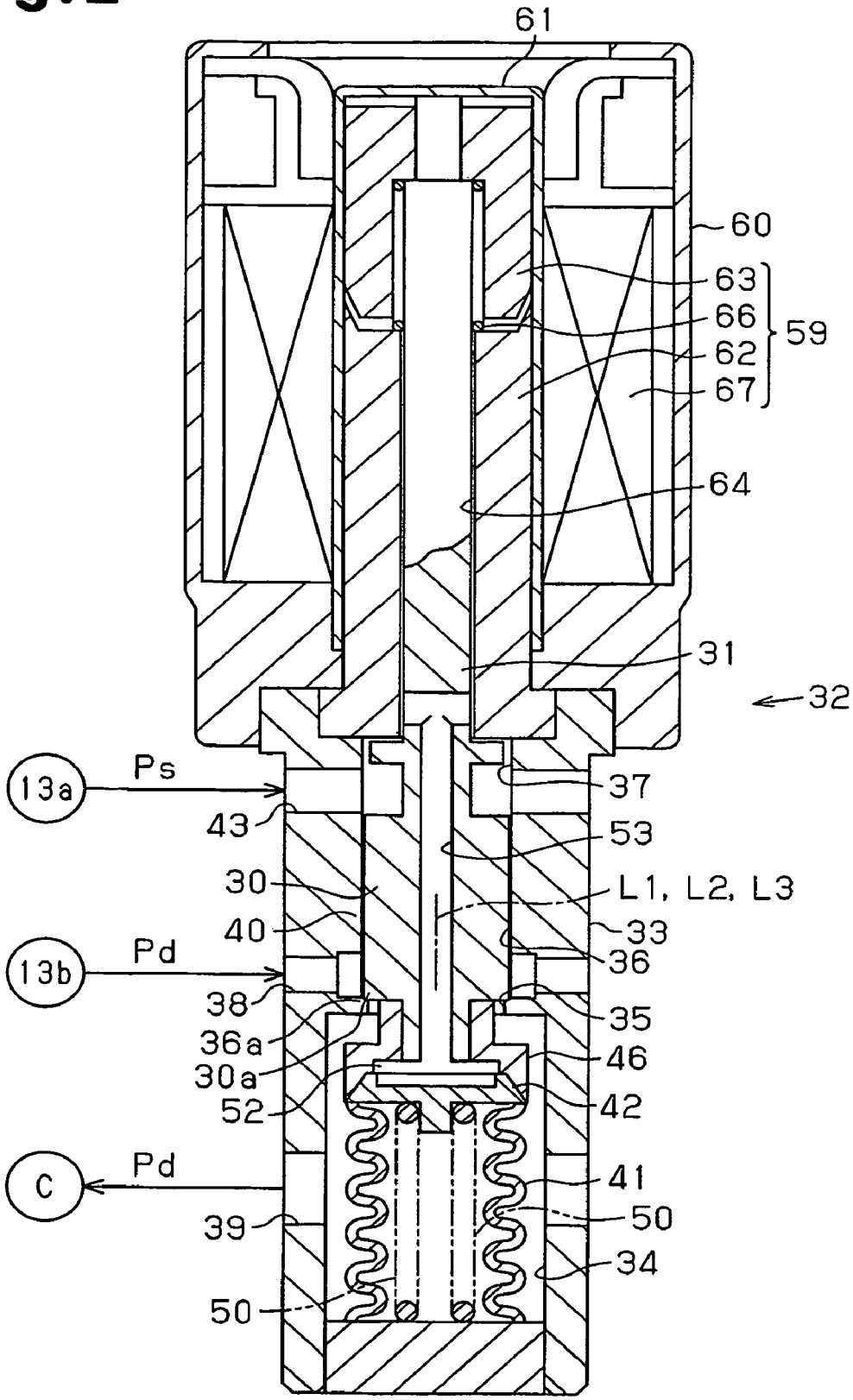
FIG. 2 is a longitudinal cross-sectional view showing the displacement control valve in accordance with the first and second embodiments.

An electromagnetic type displacement control valve 32 is disposed in the rear housing member 13 of the variable displacement compressor 10. As shown in FIG. 2, a displacement chamber 34 is defined within a valve housing 33 constituting a lower portion of a displacement control valve 32. Further, a valve hole 35 communicating with the displacement chamber 34 is formed within the valve housing 33. A diameter of the valve hole 35 is smaller than a diameter of the displacement chamber 34. Further, a valve chamber 36 communicating with the valve hole 35 is defined within the valve housing 33. A diameter of the valve chamber 36 is larger than the diameter of the valve hole 35. A step is formed in a boundary portion between the valve chamber 36 and the valve hole 35, and the step is served as a valve seat 36*a*.

Further, an actuation chamber 37 communicating with the valve chamber 36 is defined within the valve housing 33. A rod 31 is arranged within the valve housing 33 so as to be movable along an axis L2 thereof. The rod 31 reciprocates within the valve housing 33 while approximately bringing the axis L2 into line with an axis L1 of the valve chamber 36. A valve body 30 is fixed to a lower end portion of the rod 31, and the valve body 30 is arranged within the valve chamber 36. The valve body 30 reciprocates within the valve chamber 36 in accordance with the reciprocation of the rod 31.

A valve portion 30*a* of the valve body 30 selectively contacts and separates from the valve seat 36*a* in accordance with the reciprocation of the rod 31. That is, if the valve portion 30*a* contacts the valve seat 36*a*, the valve hole 35 is closed, and a seal structure is formed between the valve portion 30*a* and the valve seat 36*a*. On the basis of this seal structure, the leakage of the refrigerant gas is prevented. On the other hand, if the valve portion 30*a* separates from the valve seat 36*a*, the valve hole 35 is opened, and the seal structure mentioned above is cancelled.

A first communication path 38 communicating with the valve chamber 36 is formed within the valve housing 33. The first communication path 38 communicates with a discharge chamber 13*b* of the variable displacement compressor 10. The refrigerant gas having the discharge pressure Pd is introduced to the valve chamber 36 from the discharge chamber 13*b* via the first communication path 38. Further, a detection communication path 43 communicating with the actuation chamber 37 is formed within the valve housing 33. The detection communication path 43 communicates with the suction chamber 13*a* of the variable displacement compressor 10. The refrigerant gas having the suction pressure Ps is introduced to the actuation chamber 37 from the suction chamber 13*a* via the detection communication path 43. In the present embodiment, the valve chamber 36 corresponds to the discharge pressure zone, and the actuation chamber 37 corresponds to the suction pressure zone.

Further, a second communication path 39 communicating with the displacement chamber 34 is formed within the valve housing 33. A communication path 29 (refer to FIG. 1) communicating with the control pressure chamber C is formed in the variable displacement compressor 10, and a second communication path 39 of the displacement control valve 32 communicates with the communication path 29. The refrigerant gas having the discharge pressure Pd is supplied to the control pressure chamber C within the variable displacement compressor 10 from the displacement control valve 32 via the communication path 29. In the present embodiment, the gas passage (the flow path) is constituted by the first communication path 38, the valve chamber 36, the valve hole 35 and the displacement chamber 34.

Figure 3:
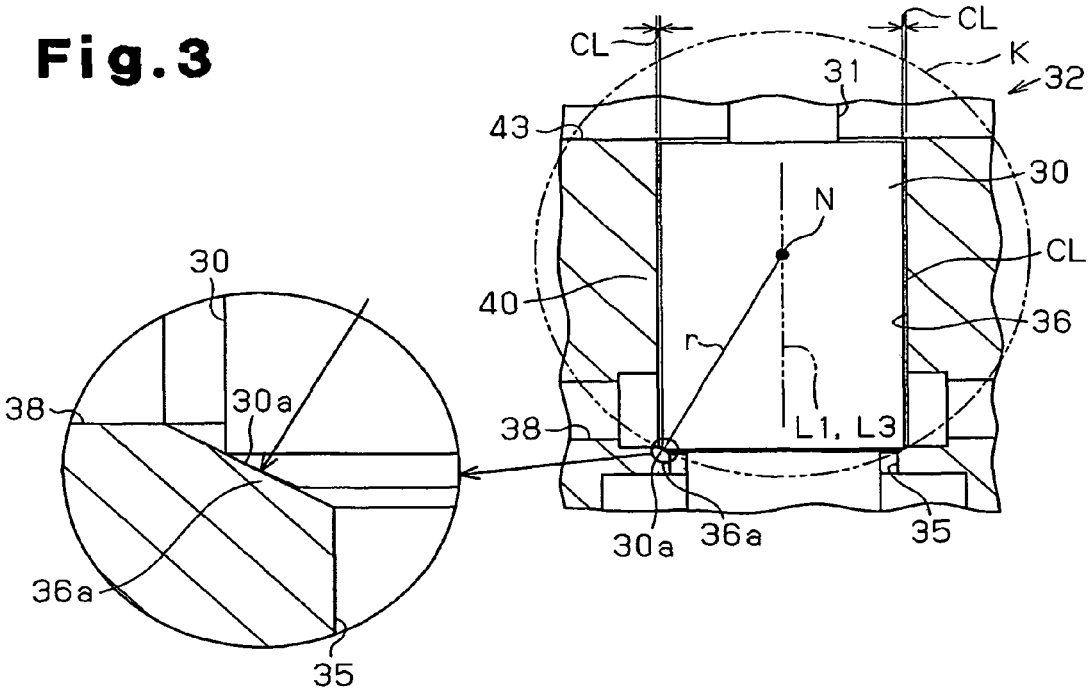
FIG. 3 is a partly enlarged cross-sectional view showing a valve portion and a valve seat in accordance with the first embodiment.

As shown in FIG. 3, an inner circumferential surface of the valve chamber 36 is formed as a guide portion 40 for guiding the movement of the valve body 30. The valve body 30 is reciprocated within the valve chamber 36 along the guide portion 40 while approximately bringing an axis L3 thereof into line with the axis L1 of the valve chamber 36. Further, the guide portion 40 sections the valve chamber 36 and the actuation chamber 37 (refer to FIG. 2). In order to smoothly reciprocate the valve body 30 within the valve chamber 36, a predetermined clearance CL is formed between the inner circumferential surface of the guide portion 40 and an outer circumferential surface of the valve body 30. In this case, a dimension of the clearance CL is set so as to prevent the refrigerant gas within the valve chamber 36 from leaking to the actuation chamber 37.

As shown in FIG. 2, a coupling portion 46 is installed to the lower end of the rod 31, and an engagement portion 42 is detachably installed to the coupling portion 46. A pressure sensing member 41 constituted by a bellows is arranged within the displacement chamber 34. An upper end of the pressure sensing member 41 is fixed to the engagement portion 42, and a lower end of the pressure sensing member 41 is fixed to the valve housing 33. A spring 50 is arranged within the pressure sensing member 41. An expansion and contraction amount of the pressure sensing member 41 is determined on the basis of a correlation between an urging force of the bellows and the spring 50, and the discharge pressure Pd and the control pressure Pc. When a moving speed of the rod 31 is high, and the valve body 30 is disconnected rapidly from the valve seat 36*a*, the coupling portion 46 is disconnected from the engagement portion 42.

An open chamber 52 is formed between the engagement portion 42 and the coupling portion 46, and an open passage 53 corresponding to the flow path is formed within the valve body 30 and the rod 31. The open passage 53 extends along the axes L3 and L2 of the valve body 30 and the rod 31. The open passage 53 connects the open chamber 52 with the actuation chamber 37, and allows the refrigerant gas to flow from the actuation chamber 37 to the open chamber 52. Accordingly, the open chamber 52 forms the suction pressure zone (the suction pressure Ps).

An accommodation tube 61 is fixed within a solenoid housing 60 structuring the upper portion of the displacement control valve 32, and a fixed iron core 62 is fixed within the accommodation tube 61. A movable iron core 63 is arranged between an upper wall of the accommodation tube 61 and the fixed iron core 62. A spring 66 is arranged between the fixed iron core 62 and the movable iron core 63. The movable iron core 63 is urged in a direction moving away from the fixed iron core 62 on the basis of the urging force of the spring 66. An insertion hole 64 is formed in the center of the fixed iron core 62, and the rod 31 is movably arranged in the insertion hole 64. The movable iron core 63 is fixed to an upper end portion of the rod 31. In order to make the rod 31 movable, a predetermined clearance is formed between an outer circumferential surface of the rod 31 and an inner circumferential surface of the fixed iron core 62.

A coil 67 is arranged within the solenoid housing 60 so as to be along an outer periphery of the accommodation tube 61. If an electric power is supplied to the coil 67, an electromagnetic force is generated in correspondence to a magnitude of the electric power. Further, since the valve body 30 moves downward together with the rod 31 on the basis of the electromagnetic force, the valve hole 35 is closed. In the present embodiment, a solenoid portion 59 corresponding to the actuation means is constituted by the fixed iron core 62, the movable iron core 63, the spring 66 and the coil 67.

On the other hand, in the case that the electric power is not supplied to the coil 67, a position of the valve body 30 in a height direction is determined on the basis of the suction pressure Ps of the refrigerant gas and the urging force of the pressure sensing member 41 (the spring 50), and an opened and closed state of the valve hole 35 is determined. On the other hand, in the case that the coil 67 is excited, the position of the valve body 30 in the height direction is determined on the basis of the electromagnetic force from the coil 67 in addition to the suction pressure Ps and the urging force of the pressure sensing member 41, and the opened and closed state of the valve hole 35 is determined. An amount of the refrigerant gas having the discharge pressure Pd flowed into the displacement chamber 34 from the first communication path 38 is regulated by opening and closing the valve hole 35. Further, it is possible to regulate an amount of the refrigerant gas having the discharge pressure Pd flowed into the control pressure chamber C within the variable displacement compressor 10 via the second communication path 39 and the communication path 29. Accordingly, a differential pressure between the control pressure Pc of the control pressure chamber C and the suction pressure Ps of the suction chamber 13*a* is changed, and an angle of inclination of the swash plate 22 of the variable displacement compressor 10 is changed in correspondence to the differential pressure. As a result, a stroke amount of the pistons 24 is changed, and the displacement of the variable displacement compressor 10 is regulated.

As shown in FIG. 3, the valve seat 36*a* is tapered and is expanded toward the valve chamber 36 from the valve hole 35. On the other hand, the valve portion 30*a* of the valve body 30 is formed in a circular arc cross sectional shape along a surface of an imaginary sphere K in which an intermediate point of a length of the guide portion 40 along the axis L1 of the valve chamber 36 is set to a center N on the axis L1, and a distance from the center N to a contact point between a valve seat 36*a* and the valve portion 30*a* is set to a radius r. That is, when the valve body 30 is brought into contact with the valve seat 36*a* while bringing the axis L3 thereof into line with the axis L1 of the valve chamber 36, the valve portion 30*a* of the valve body 30 and the surface (a circular arc of a virtual circle in FIG. 3) of the sphere K are partly in line.

In a state in which the valve hole 35 is closed as mentioned above, the valve portion 30*a* of the valve body 30 is in line contact with the tapered valve seat 36*a*. A seal structure is formed between the valve portion 30*a* and the valve seat 36*a* on the basis of the line contact between the valve portion 30*a* and the valve seat 36*a*. In the valve portion 30*a*, a range forming the circular arc cross sectional shape is set while taking into consideration the clearance CL between the valve body 30 and the guide portion 40. There is a case that the clearance CL that is formed along the outer circumferential surface of the valve body 30 allows the valve body 30 to tilt. As long as the range forming the circular arc cross sectional shape is properly set in the valve portion 30*a*, the line contact between the valve portion 30*a* and the valve seat 36*a* is securely maintained even if the valve body 30 is tilted.

Figure 4:
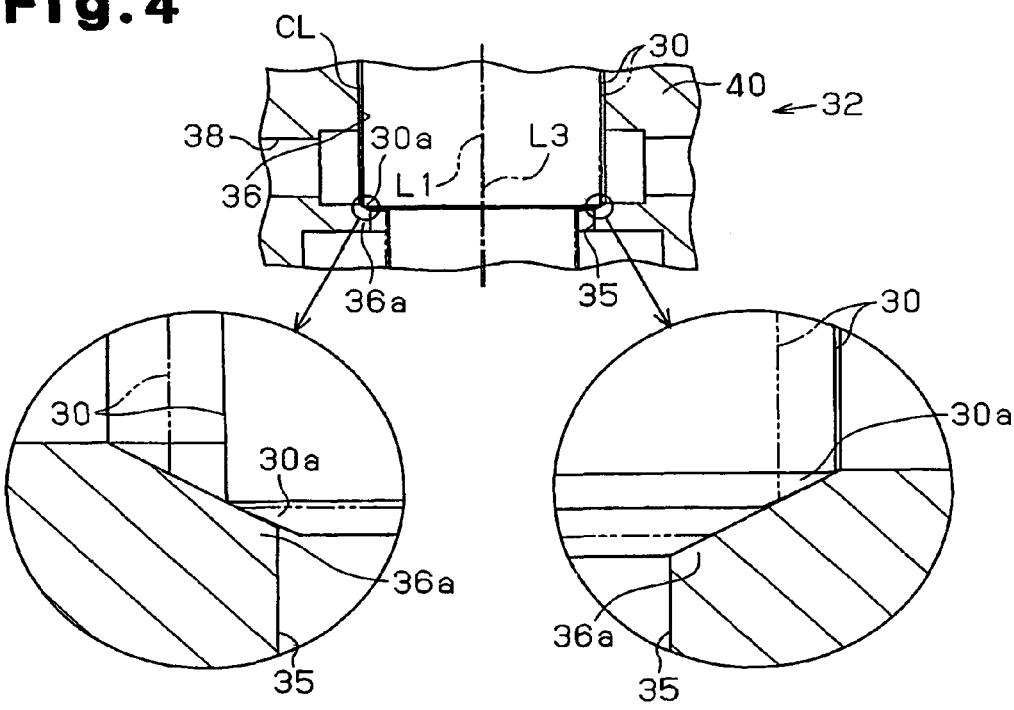
FIG. 4 is a partly enlarged cross-sectional view showing the valve portion and the valve seat at a time when a valve body is tilted.

Next, a description will be an operation in the case that the rod 31 is tilted, with reference to FIGS. 1 and 4.

As shown in FIG. 1, in the displacement control valve 32 mentioned above, the clearance is formed between the outer circumferential surface of the rod 31 and the inner circumferential surface of the fixed iron core 62. As shown in FIG. 4, there is a possibility that the valve body 30 is tilted together with the rod 31 due to the clearance. At that time, in a state in which the valve hole 35 is closed, there is a case that the valve body 30 is tilted around the intermediate point N (the center of the sphere K) shown in FIG. 3.

In the present embodiment, the valve portion 30*a* of the valve body 30 is formed in the circular arc cross sectional shape along the surface (the circular arc of the virtual circle shown in FIG. 3) of the sphere K. Accordingly, even if the valve body 30 is tilted, the valve portion 30*a* is not disconnected from the valve seat 36*a*, and the line contact between the valve portion 30*a* and the valve seat 36*a* is maintained. As a result, the gap is not formed between the valve body 30 and the valve seat 36*a*.

Further, the clearance CL exists along the outer circumferential surface of the valve body 30, within the guide portion 40. Further, there is a case that the valve body 30 is tilted around the intermediate point N (the center of the sphere K) shown in FIG. 3 due to the clearance CL. In the present embodiment, since the valve portion 30*a* of the valve body 30 is formed in the circular arc cross sectional shape along the surface of the sphere K shown in FIG. 3, it is possible to securely maintain the line contact between the valve portion 30*a* and the valve seat 36*a* even if the valve body 30 is tilted, and it is possible to maintain the seal structure formed between the valve portion 30*a* and the valve seat 36*a*.

In accordance with the first embodiment, the following advantages are obtained.

(1) The valve portion 30*a* of the valve body 30 is formed in the circular arc cross sectional shape along the surface of the sphere K. Accordingly, since the valve portion 30*a* is moved along the surface of the sphere K even if the valve body 30 is tilted, it is possible to maintain the line contact between the valve portion 30*a* and the valve seat 36*a*. Therefore, it is possible to maintain the seal structure between the valve portion 30*a* and the valve seat 36*a*, and it is possible to prevent the refrigerant gas from leaking from the portion between the valve portion 30*a* and the valve seat 36*a*.

Particularly, in the case that the open passage 53 is formed within the rod 31 and the valve body 30, the gap between the valve portion 30*a* and the valve seat 36*a* is prone to become large at a time when the valve body 30 is tilted. On that point, in the present embodiment, since the valve portion 30*a* is formed in the circular arc cross sectional shape along the surface of the sphere K, the line contact between the valve portion 30*a* and the valve seat 36*a* is maintained even if the valve body 30 is tilted. Accordingly, since it is possible to maintain the seal structure between the valve portion 30*a* and the valve seat 36*a*, it is possible to prevent the refrigerant gas from leaking through the space between the valve portion 30*a* and the valve seat 36*a*. Accordingly, it is possible to close the valve hole 35 while preventing the refrigerant gas from leaking, whereby it is possible to accurately control the displacement control valve 32.

(2) The valve portion 30*a* is formed in the circular arc cross sectional shape along the surface of the sphere K. Accordingly, even if the valve body 30 is tilted due to the clearance CL existing along the outer circumferential surface of the valve body 30, it is possible to maintain the line contact between the valve portion 30*a* and the valve seat 36*a*.

(3) The range forming the circular arc cross sectional shape of the valve portion 30*a* is set by taking into consideration the clearance CL between the valve body 30 and the guide portion 40. Accordingly, even if the valve body 30 is tilted, it is possible to further prevent the gap from being formed between the valve portion 30*a* and the valve seat 36*a*.

(4) While the valve portion 30*a* is formed in the circular arc cross sectional shape, the valve seat 36*a* is formed in the taper shape. It is possible to bring the valve portion 30*a* into line contact with the valve seat 36*a* on the basis of these shapes. In this case, it is possible to reduce a friction surface generated between the valve portion 30*a* and the valve seat 36*a*, in comparison with the case that the valve portion 30*a* and the valve seat 36*a* are brought into surface contact with each other. Accordingly, since the deformation of the valve seat 36*a* due to the abrasion is suppressed, it is possible to contribute to the prevention of the leakage of the refrigerant gas.

Second Embodiment

Next, a description will be given of a second embodiment according to the present invention with reference to FIG. 5. Since the second embodiment is structured only by changing the shapes of the valve portion 30*a* and the valve seat 36*a* in the first embodiment, a detailed description of the same portions of those of the first embodiment will be omitted.

Figure 5:
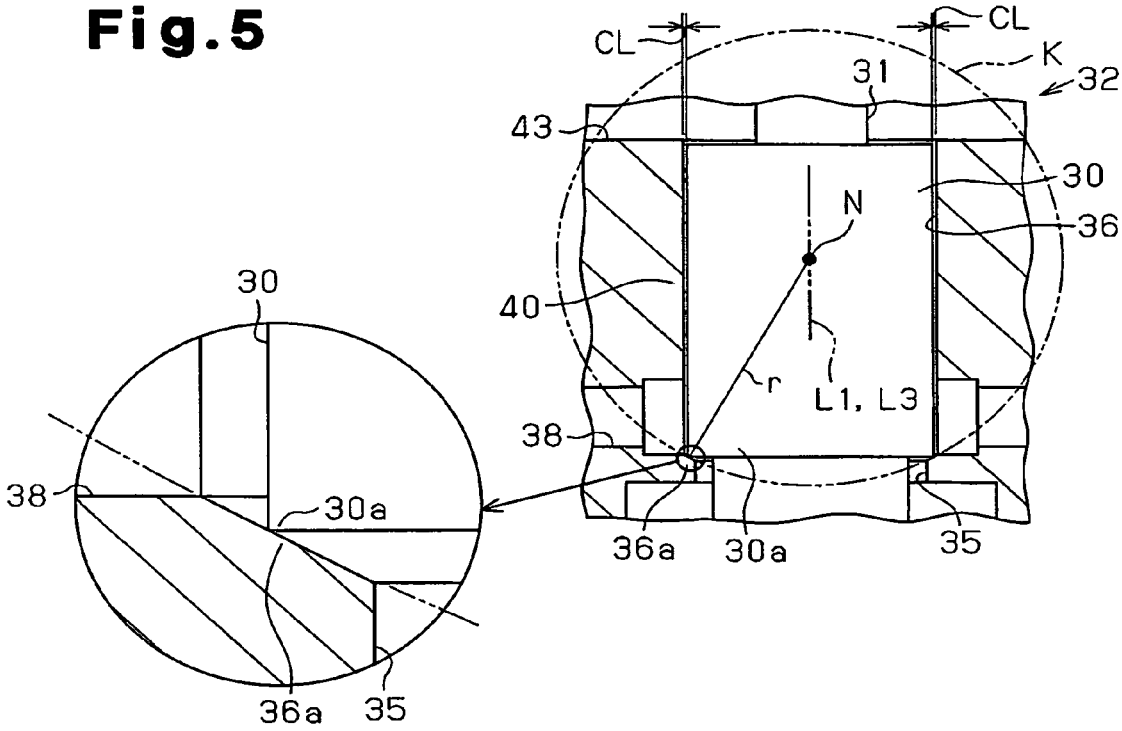
FIG. 5 is a partly enlarged cross-sectional view showing a valve portion and a valve seat in accordance with the second embodiment.

As shown in FIG. 5, the valve portion 30*a* of the valve body 30 is different from the first embodiment and is constituted by an end edge of the columnar valve body 30. In other words, the valve portion 30*a* is constituted by a corner portion of the valve body 30, and is formed in a right angle cross sectional shape. On the other hand, the valve seat 36*a* of the valve chamber 36 is formed in the circular arc cross sectional shape along the surface (the circular arc of the imaginary circle) of the imaginary sphere K in which the intermediate point of the length of the guide portion 40 along the axis L1 of the valve chamber 36 is set to the center N on the axis L1, and the distance from the center N to the contact point between the valve seat 36*a* and the valve portion 30*a* is set to the radius r. Accordingly, since the valve portion 30*a* is moved along the surface of the sphere K even if the valve body 30 is tilted, it is possible to maintain the line contact between the valve portion 30*a* and the valve seat 36*a*.

Further, in this embodiment, since the valve portion 30*a* is constituted by the corner portion of the valve body 30, the pressure receiving surface receiving the pressure of the refrigerant gas does not exist in the lower surface of the valve body 30 in a state in which the valve hole 35 is closed. In other words, in the state in which the valve hole 35 is closed, only the outer circumferential surface of the valve body 30 forms the pressure receiving surface receiving the pressure of the refrigerant gas.

Therefore, in accordance with the second embodiment, the following advantage is achieved.

(5) In the displacement control valve 32 in accordance with the second embodiment, the pressure receiving surface receiving the pressure of the refrigerant gas does not exist in the lower surface of the valve body 30, unlike the first embodiment. Accordingly, it is possible to minimize an influence to the valve body 30 by the refrigerant gas from the first communication path 38. Therefore, even if the refrigerant gas is introduced to the valve chamber 36, it is possible to prevent the valve body 30 from moving to the upper side by the refrigerant gas so as to open the valve hole 35. Accordingly, it is possible to more precisely execute the displacement control of the displacement control valve 32.

The embodiments mentioned above may be modified as follows.

In each of the embodiments, the structure may be made such that the valve portion 30*a* is formed in the circular arc cross sectional shape along the surface of the sphere K, and the valve seat 36*a* is formed as the end edge of the valve hole 35. In this case, in a state in which the valve hole 35 is closed, a part of the valve portion 30*a* of the valve body 30 enters the valve hole 35.

In each of the embodiments mentioned above, the structure may be made such that both of the valve portion 30*a* and the valve seat 36*a* are formed in the circular arc cross sectional shape along the surface of the sphere K, and the valve portion 30*a* and the valve seat 36*a* are brought into surface contact with each other.

In each of the embodiments mentioned above, the displacement control valve 32 may be changed to other structures instead of the structure in each of the embodiments. For example, the displacement control valve 32 may be formed as a control valve executing the displacement control of the displacement control valve 32 in correspondence to the differential pressure of the discharge pressure.

In each of the embodiments mentioned above, the seal structure formed between the valve portion 30*a* and the valve seat 36*a* may be applied to other seal structures than the displacement control valve 32. For example, the seal structure may be applied to a seal structure of a refrigerant flow path of a refrigerant circulation path, a valve apparatus of a hydraulic circuit and the like.

In each of the embodiments mentioned above, a spring may be employed as the actuation means of the displacement control valve 32, in place of the solenoid portion 59.

The invention claimed is:

1. A displacement control valve that forms a part of a circulation path of a refrigerant gas and is used in a variable displacement compressor capable of changing a displacement of the refrigerant gas, comprising:

a valve housing having a displacement chamber, a valve chamber, and an actuation chamber provided within the valve housing;

a solenoid housing having actuation means provided within the solenoid housing;

the valve chamber forming a part of a gas passage in which the refrigerant gas flows and having an axis and a valve seat;

a valve body being capable of reciprocating along an inner circumferential surface of the valve chamber;

the valve body having a valve portion;

the valve portion selectively contacting and separating from the valve seat of the valve chamber, whereby the gas passage is selectively opened and closed;

a rod having and end portion fixed to the valve body and integrally moving with the valve body;

the actuation means actuating the rod for positioning the valve body within the valve chamber;

a flow passage provided within the rod and the valve body, and in which the refrigerant gas flows;

a guide portion for guiding the reciprocating movement of the valve body along the axis of the valve chamber, wherein the guide portion is arranged on the inner circumferential surface of the valve chamber and sections the valve chamber and the actuation chamber, and a predetermined clearance is formed between an inner circumferential surface of the guide portion and an outer circumferential surface of the valve body; and the valve portion being formed along a surface of an imaginary sphere having a center and a radius, the center of the imaginary sphere being set to an intersection of the axis of the valve chamber with an imaginary surface that orthogonally intersects with the axis and includes a middle point of a length of the guide portion along the axis, the radius of the imaginary sphere being set to a distance from the center of the imaginary sphere to a contact point between the valve seat and the valve portion, wherein in a state where the gas passage is closed when the valve body tilts due to the predetermined clearance between the inner circumferential surface of the guide portion and the outer circumferential surface of the valve body, the valve body is tilted around the center of the imaginary sphere so that the line contact between the valve portion and the valve seat is maintained.

2. The displacement control valve according to claim 1, wherein only the valve portion is formed in a circular arc cross sectional shape.

3. A displacement control valve that form a part of a circulation path of a refrigerant gas and is used in a variable displacement compressor capable of changing a displacement of the refrigerant gas, the displacement control valve comprising:

a valve housing having a displacement chamber, a valve chamber and an actuation chamber provided within the valve housing;

a solenoid housing having actuation means provided within the solenoid housing; the valve chamber forming a part of a gas passage in which the refrigerant gas flows and having an axis and a valve seat;

a valve body being capable of reciprocating along an inner circumferential surface of the valve chamber;

the valve body having a valve portion;

the valve portion selectively contacting and separating from the valve seat of the valve chamber, whereby the gas passage is selectively opened and closed;

a rod having an end portion fixed to the valve body and integrally moving with the valve body;

the actuation means actuating the rod for positioning the valve body within the valve chamber;

a flow passage provided within the rod and the valve body, and in which the refrigerant gas flows;

a guide portion for guiding the reciprocating movement of the valve body along the axis of the valve chamber, wherein the guide portion is arranged on the inner circumferential surface of the valve chamber and sections the valve chamber and the actuation chamber, and a predetermined clearance is formed between an inner circumferential surface of the guide portion and an outer circumferential surface of the valve body; and the valve seat being formed along a surface of an imaginary sphere having a center and a radius, the center of the imaginary sphere being set to an intersection of the axis of the valve chamber with an imaginary surface that orthogonally intersects with the axis and includes a middle point of a length of the guide portion along the axis, the radius of the imaginary sphere being set to the distance from the center to the contact point between the valve seat and the valve portion, wherein in a state where the gas passage is closed when the valve body tilts due to the predetermined clearance between the inner circumferential surface of the guide portion and the outer circumferential surface of the valve body, the valve body is tilted around the center of the imaginary sphere so that the line contact between the valve portion and the valve seat is maintained.

4. The displacement control valve according to claim 2, wherein the valve seat is tapered, and is expanded toward the valve body from the valve seat.

5. The displacement control valve according to claim 1, wherein the valve seat is formed in a circular arc cross sectional shape, and the valve portion is formed by an end edge of the valve body.

6. The displacement control valve according to claim 5, wherein the valve portion is formed in a rectangular cross sectional shape.

7. The displacement control valve according to claim 1, wherein the actuation means is a magnetic solenoid.

8. The displacement control valve according to claim 1, wherein the variable displacement compressor is used in an air conditioner for a vehicle.

9. The displacement control valve according to claim 3, wherein only the valve portion is formed in a circular arc cross sectional shape.

10. The displacement control valve according to claim 9, wherein a range forming the circular arc cross sectional shape in the valve portion is set in correspondence to a size of a clearance formed between the valve body and the guide portion.

11. The displacement control valve according to claim 9, wherein the valve seat is tapered, and is expanded toward the valve body from the valve seat.

12. The displacement control valve according to claim 3, wherein the valve seat is formed in a circular arc cross sectional shape, and the valve portion is formed by an end edge of the valve body.

13. The displacement control valve according to claim 12, wherein the valve portion is formed in a rectangular cross sectional shape.

14. The displacement control valve according to claim 3, wherein the actuation means is a magnetic solenoid.

15. The displacement control valve according to claim 3, wherein the variable displacement compressor is used in an air conditioner for a vehicle.

16. The displacement control valve according to claim 2, wherein a range forming the circular arc cross sectional shape in the valve portion is set in correspondence to a size of a clearance formed between the valve body and the guide portion.

* * * * *